US009156662B2

(12) United States Patent
Hakkarainen et al.

(10) Patent No.: US 9,156,662 B2
(45) Date of Patent: Oct. 13, 2015

(54) MONITORING SYSTEM AND METHOD

(75) Inventors: Simo Hakkarainen, Hyvinkää (FI); Ari Lehtinen, Hyvinkää (FI); Matti Pekkarinen, Espoo (FI); Jussi Kiova, Helsinki (FI); Jukka Saikkonen, Klaukkala (FI); Kari Wallgren, Hyvinkää (FI); Don Paulino, Cape Coral, FL (US)

(73) Assignee: Konecranes PLC, Hyvinkaa (FI)

( * ) Notice: Subject to any disclaimer, the term of this patent is extended or adjusted under 35 U.S.C. 154(b) by 0 days.

(21) Appl. No.: 13/982,702

(22) PCT Filed: Feb. 2, 2012

(86) PCT No.: PCT/FI2012/050098

§ 371 (c)(1),
(2), (4) Date: Jul. 30, 2013

(87) PCT Pub. No.: WO2012/104489

PCT Pub. Date: Aug. 9, 2012

(65) Prior Publication Data

US 2013/0311053 A1 Nov. 21, 2013

(30) Foreign Application Priority Data

Feb. 3, 2011 (FI) ..... 20115111

(51) Int. Cl.
*B66C 9/16* (2006.01)

(52) U.S. Cl.
CPC ..... *B66C 9/16* (2013.01)

(58) Field of Classification Search
None
See application file for complete search history.

(56) References Cited

U.S. PATENT DOCUMENTS 4,095,160 A * 6/1978 Sedlmayer et al. ..... 318/675
4,424,875 A * 1/1984 Yoshida ..... 701/23

(Continued)

FOREIGN PATENT DOCUMENTS

CN 1485264 A 3/2004
CN 1 210 199 C 7/2005

(Continued)

OTHER PUBLICATIONS

Toshihisa Fujiwara, et al., Translation of JP Patent Applicaiton Publication 60-060509, Apr. 8, 1985, Translated by FLS, Inc.*

*Primary Examiner* — John R Olszewski
*Assistant Examiner* — David Merlino
(74) *Attorney, Agent, or Firm* — Birch, Stewart, Kolasch & Birch, LLP

(57) ABSTRACT

A system with an apparatus that moves on wheels along a track defined by rails, and comprises two opposite sides carried by two or more wheels. The apparatus comprises detectors, at least one detector in either side of the apparatus in a known spatial connection with a wheel for generating to the control unit a signal that represents a measured lateral distance of a specific part of the wheel from a rail. Signals received from detectors are associated with position data that represents a specific position along the track where the lateral distance of the specific part of the wheel from the rail was measured. Signals received from detectors in spatial connection with wheels in opposite sides of the apparatus are used to generate an indication that represents temporal dimensional compatibility of the apparatus and the track. An effective tool for advanced monitoring interoperability of the apparatus and the track.

16 Claims, 3 Drawing Sheets

(56) References Cited

U.S. PATENT DOCUMENTS

| | | | | |
|---|---|---|---|---|
| 4,890,750 | A * | 1/1990 | Stern | 212/276 |
| 5,610,816 | A * | 3/1997 | Kim | 701/24 |
| 5,866,997 | A * | 2/1999 | Sorsa et al. | 318/66 |
| 7,050,926 | B2 * | 5/2006 | Theurer et al. | 702/150 |
| 7,428,781 | B2 * | 9/2008 | Wickhart | 33/286 |
| 2006/0158970 | A1 * | 7/2006 | Van Der Burg | 369/44.11 |
| 2009/0192758 | A1 * | 7/2009 | Pelletier | 702/158 |
| 2011/0180506 | A1 * | 7/2011 | Lerchenmuller | 212/276 |
| 2012/0006946 | A1 * | 1/2012 | Clarissou | 246/120 |
| 2012/0224056 | A1 * | 9/2012 | Sunio et al. | 348/135 |

FOREIGN PATENT DOCUMENTS

| | | | | |
|---|---|---|---|---|
| DE | 278 570 | A1 | 5/1990 | |
| DE | 198 27 271 | A1 | 12/1999 | |
| FI | 100594 | B | 1/1998 | |
| GB | 2112548 | A * | 7/1983 | B66C 9/16 |
| JP | 60-060509 | A | 4/1985 | |
| JP | 07-069576 | A | 3/1995 | |
| JP | 09-089562 | A | 4/1997 | |
| RU | 2 405 735 | C1 | 12/2010 | |
| SU | 396301 | A1 | 8/1973 | |

* cited by examiner

MONITORING SYSTEM AND METHOD

FIELD OF THE INVENTION

The present invention relates to apparatuses moving on tracks defined by rails, and more particularly to a system, a method and a computer program product according to the preambles of the independent claims.

BACKGROUND OF THE INVENTION

A track refers here to a structure that provides a base and direction for an object to move along. More specifically the track refers here to a structure defined by at least two rails that extend and run parallel to each other in a defined direction. An object moving on the track typically comprises some kind of engagement mechanism, for example flanged wheels that allow progress of the object on the rails and retain the moving object on the rails.

In order to achieve smooth progress of the object along the track, the dimensions of the track and the dimensions of the object need to match. When systems applying track delivery are implemented, optimal compliance between the track and the object moving on the track is carefully established. However, during installation or operation of such systems mismatch between these track delivery elements may appear. Such situations are very undesirable and rectifying them easily leads to significant costs.

Dimensioning of track delivery elements is relatively easy when the elements are small and no big forces act upon them. However, also large scale systems that bear and move significant loads apply tracks defined by rails, and with them already initial dimensioning of the track delivery elements is challenging. For example in crane bridges, lateral dimension of the bridge is of the order or meters or tens of meters in comparison with the order of centimeter lateral dimensions of the rail. In addition, the loads carried by the bridge are very heavy so dimensions of the bridge may vary according to whether loaded or unloaded states are in question. It also needs to be considered that the bridge may swing considerably during operation. Variations in the dimensions of the bridge itself may be relatively accurately estimated and anticipated but variations in dimensions of the track are very difficult to control and manage. Furthermore, crane bridges are elevated structures so that the rails typically run in heights. Any installation and service operations in such heights are already inherently challenging. In most cases the rails are also assembled by a different party than the crane bridge manufacturer such that true compliance of the track delivery elements may only be tested when both of these track delivery elements are completely installed.

On the other hand, even if excellent compliance is reached at installation, the situation may change in use. The rails are typically fixed on a foundation, for example a concrete or steel structure or the like. If this foundation for some reason (earth moves, earthquake, material problems) moves, the rails move and dimensions of the track change. Also the track itself may deteriorate or fail during operation. For example, a bolt from rail joints may become loose, and cause a deformation to the rail and thereby to the whole track.

All these reasons may lead to loss of compliance between the track and the bridge, and the severe effects they cause. Primarily, when incompliant track delivery elements are in use, the engaging elements rub against each other and cause wear and tear to the parts. Changing parts of heavy duty elements, for example, crane bridges is very costly and cause disturbances to the production process in which track delivery is applied. In addition, in some advanced track delivery implementations progress of the object is controlled by measurements and drive logics that are based on expected lateral compliance between dimensions of the track delivery elements. When this compliance begins to deteriorate, the drive logic may begin to fail or at least not operate optimally.

In order to avoid these disadvantages, a lot of effort is vested to monitoring dimensional compliance between the track and the apparatus moving along the track. Especially with heavy duty crane systems, the savings both in terms of production down time and maintenance costs is significant if temporal compliance of the track delivery elements can be carefully followed. In practise, monitoring of these type of systems is, however, very difficult. Traditionally, compliance monitoring has basically equalled to track monitoring, i.e. monitoring of the condition and dimensions of the track. Track monitoring is often performed visually, either by a maintenance person practically walking in the elevated track and observing the state of the track, and possibly recording it with a camera. Such visual observations are not accurate and the track and/or facility using apparatus needs to be shut down for the time of the observation. The method is also laborious and risky, so intervals between such monitoring events tend to be too long for practical situations.

In some enhanced solutions, a separate unit is moved along the track to measure its dimensions. In some solutions a separate unit may be fixed to the bridge and moved in front of the bridge to collect measurement information along its way. In other systems, the separate unit is a mobile unit that may be remotely controlled to move along the track and record measured information during its movement. These track measurement systems provide more accurate information than visual observations, but require separately moved measurement entities and require a break to normal operations of the crane bridge. In addition, they only provide information on compliance between track delivery elements when there is no load. The compliance may, in some cases, change quite significantly when load and movements of the bridge resulting from the variably driven load step in. Mere track measurements are no longer sufficient; a more holistic view to the interoperability of the track delivery elements is needed.

SUMMARY

An object of the present invention is thus to provide a method and an apparatus for improved monitoring of compliance between and apparatus and a track defined by rails, along which wheels of the apparatus move. The objects of the invention are achieved by a system, a method and a computer program product, which are characterized by what is stated in the independent claims. Specific embodiments of the invention are disclosed in the dependent claims as well as in the following detailed description and the attached drawings.

Embodiments of the invention apply an apparatus configured to move on wheels along a track defined by rails, and a control unit in operative connection with the apparatus. Signals received from detectors in opposite sides of the apparatus and with a matching time indication during operation of the apparatus are taken to a control unit and are used to generate an indication that represents temporal dimensional compatibility of the apparatus and the track. Such a temporal indication, and the possibility to continuously collect history data in various operative conditions provides an effective tool for advanced monitoring of the interoperability of the track delivery elements during use.

In the context of the present invention the term "temporal dimensional compatibility" should be understood such that "temporal" relates to time as an indirect quantity only: for instance, when measurements are collected, time may act as a link that connects the crane's position (as a function of time) and the dimensional compatibility (as a function of time, when measurements were collected), and as a result it is possible to determine the dimensional compatibility (as a function of the crane's position). On the other hand, when the measurements are used in real-time to minimize chafe between wheel flanges and the rails, the "temporal dimensional compatibility" means "dimensional compatibility in the position that the crane is moving into". In short, what is ultimately desired is information on dimensional compatibility, at various locations, between the dimensions of the tracks and the wheels (particularly the flanges of the wheels), and time may serve as an interim variable for providing a link between:

1. information on dimensional compatibility at various locations where the crane has performed measurements; and
2. information on dimensional compatibility at the location the crane is moving into.

Further embodiments of the invention provide several further advantages that are discussed more with the respective detailed descriptions of the embodiments.

BRIEF DESCRIPTION OF THE DRAWINGS

In the following the invention will be described in greater detail by means of preferred embodiments with reference to the attached [accompanying] drawings, in which.

DETAILED DESCRIPTION OF SOME EMBODIMENTS

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Different embodiments will be described using an example of system architecture without, however, restricting the invention to the disclosed terms and structures.

Figure 1:
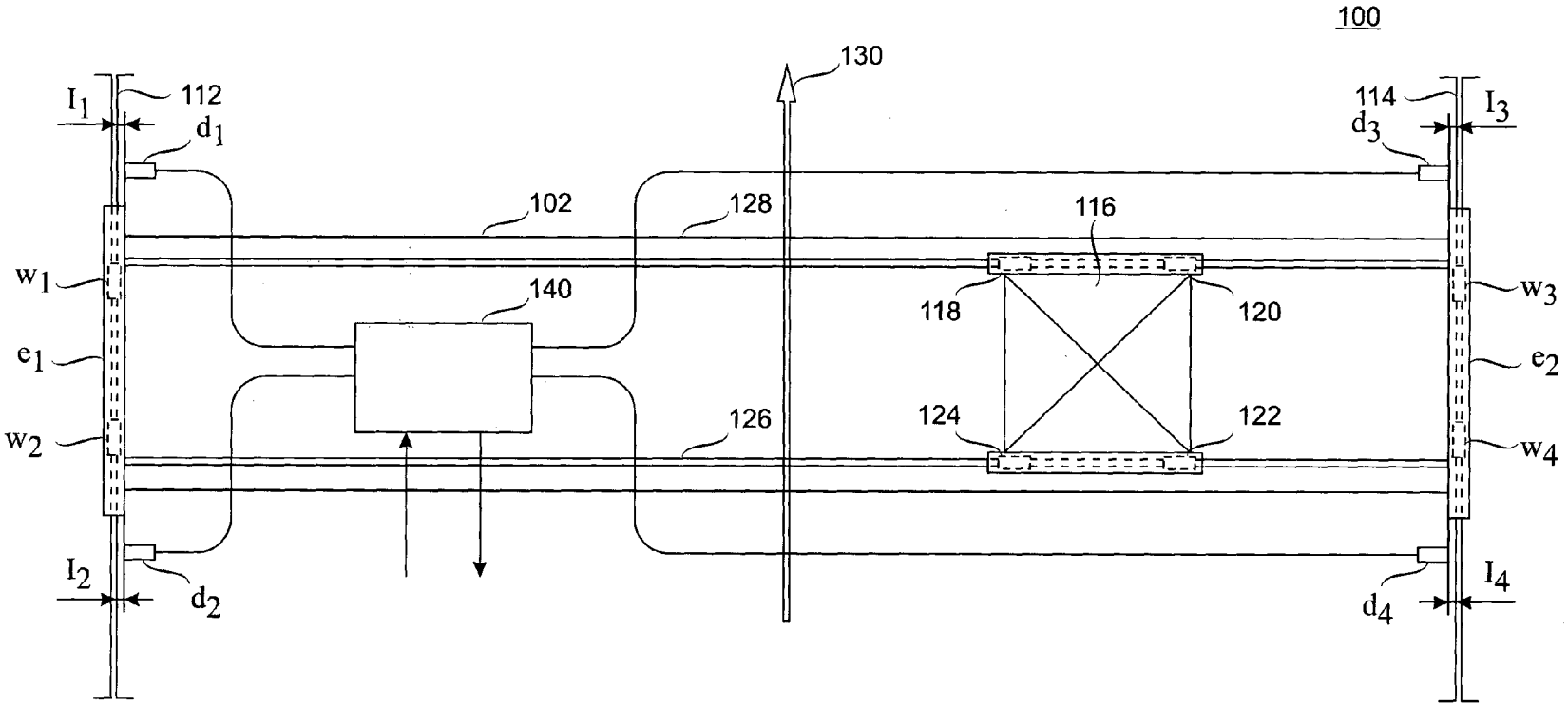
FIG. 1 shows a top view of an embodiment of the apparatus.

FIG. 1 shows an arrangement that represents an interconnection of entities in an embodiment of a track monitoring system 100. FIG. 1 is a simplified system architecture chart that shows only elements and functional entities necessary to describe the implementation of the invention in the present embodiment. It is apparent to a person skilled in the art that measuring systems may also comprise other structures not explicitly shown in FIG. 1. The illustrated entities represent logical units and connections that may have various physical implementations, generally known to a person skilled in the art. In general, it should be noted that some of the functions, structures, and elements used for creating a context for the disclosed embodiments may be, as such, irrelevant to the actual invention. Words and expressions in the following descriptions are intended to illustrate, not to restrict, the invention or the embodiment.

The enhanced monitoring system 100 according to the invention comprises an apparatus configured to move on wheels along a track defined by rails 112, 114. An example of such an apparatus is a crane bridge 102, a top view of which is shown in FIG. 1. The apparatus comprises a body with two opposite sides carried by two or more wheels. In some apparatuses, like in the crane bridge 102 of FIG. 1, the body comprises an elongate element with a first end $e_1$ and a second end $e_2$, where the first end $e_1$ corresponds to one side and the second end $e_2$ to the opposite side of the apparatus. Each of these ends $e_1$, $e_2$ is fixed to at least two successive wheels $w_1$, $w_2$, $w_3$, $w_4$. The wheels in the ends $e_1$, $e_2$ are arranged such that when the two wheels $w_1$, $w_2$ of an end $e_1$ run successively on one rail 112, the end $e_1$ moves on the rail 112 to the direction 130 of the track. Accordingly, when the ends $e_1$, $e_2$ progress on their respective rails 112, 114, the body of the apparatus 102 moves along the track defined by these rails 112, 114.

The crane bridge 102 typically comprises a trolley 116 that may be moved on wheels 118, 120, 122, 124 along rails 126, 128 in the bridge. The wheels $w_1$, $w_2$, $w_3$, $w_4$ of the crane bridge and the wheels 118, 120, 122, 124 of the trolley are connected to a driving system (not shown) by means of which a precise speed control for both the bridge and the trolley are achieved. In typical implementations each $w_1$, $w_2$, $w_3$, $w_4$ of the wheels, or pairs ($w_1$, $w_2$) and ($w_3$, $w_4$) of wheels have a specific motor to which a specific motor drive has been arranged. The motor drives are controlled by drive control logic according to programmed control schemes and control commands received from the operating system of the crane bridge.

In the present embodiment of the track monitoring system, both ends $e_1$, $e_2$ of the bridge have been equipped with at least two successive detectors $d_1$, $d_2$ and $d_3$, $d_4$. A detector refers here to a device that measures a physical quantity and converts it into an electrical signal which can be read by another electrical device. In the present embodiment, the detectors measure a lateral distance from the detector to the rail. In respect to a rail that extends in a direction, lateral direction refers here to a direction perpendicular to the direction of the rail. Ultrasonic short-range distance sensors or triangulation based laser sensors, for example, may be used for the purpose. Each of these detectors is in spatial connection with one wheel such that a signal generated by a detector $d_1$, $d_2$, $d_3$, $d_4$ corresponds with a lateral distance $I_1$, $I_2$, $I_3$, $I_4$ of a specific part of the wheel $w_1$, $w_2$, $w_3$, $w_4$ that the detector is in connection with from the respective rail 112, 114 at the time of measurement.

It is noted that FIG. 1 is a block chart for illustrating elements relevant for the embodiment, not a strict dimensional representation of the device architecture. In order to more clearly show the relevant entities and distances, detectors $d_1$, $d_2$, $d_3$, $d_4$ are shown in FIG. 1 as separately fixed elements outside the end of the bridge. In actual implementations detectors may indeed be assembled to guide roller pairs (not shown) that run in the front and rear sides of the ends of the bridge and ensure that the bridge remains on rails. However, the longitudinal position (position in the direction of the track) of the detectors in respect of its related wheel with is not, as such, relevant.

The positions of a detector and a wheel need, however, to be in a fixed spatial connection such that a signal generated by the detector at one time represents the lateral distance of a specific part of the related wheel from a rail at the same time. Accordingly, when the distance between the detector and the specific part of its related wheel is fixed and known, this known distance can always be considered together with distances measured with detector to determine the varying lateral distance of the specific part of the related wheel from the rail.

Furthermore, the apparatus is assembled in such a way that during movement of the apparatus the wheels rotate in fixed lateral positions in respect of the apparatus. Due to the fixed spatial connection between the wheels and the detectors, when the apparatus progresses along the track, the detectors progress correspondingly along the track. The system comprises means for recording progress of a specific part of the apparatus along the track such that a record that stores positions of a specific part of the apparatus along the track as a function of time is generated. This means that at least during a time the lateral distance of a specific part of the wheel from a rail is measured, the position of the apparatus, and thus the position of the wheels and the detectors along the track is exactly known and available to the control unit. A signal generated by a detector may thus be easily mapped with the record to a specific position along the track where the lateral distance of the specific part of the wheel from the rail was measured.

It is noted that defining positions where the measurements take place may be implemented in many ways. One possibility is to record progress of the apparatus along the track, and use the recorded information to map a distance measured at a specific time to a measured distance at a specific position along the track. An embodiment applying this is described in the following. It is, however, noted that other methods for associating measured lateral distances to positions along the rails may be applied within the scope of protection. For example, the detectors may be configured to take measurements in defined positions or intervals along the rail such that timing of signals is not necessary. Such variations in measuring arrangements are obvious for a person skilled in the art.

For example, let us assume that the record stores positions of a specific part of the apparatus along the track as distances to a fixed reference position and associates the positions with a time when the specific part of the apparatus passed that position. When a signal from a specific detector arrives and time of measurement by the detector is available to the control unit, it simply has to use the record to map the time of the measurement by the detector to a specific position of a specific part of the apparatus along the track. Having the fixed distance between the detector and the specific part of the apparatus, the control unit can determine the measurement position along the track as a sum of the determined specific position of the specific part of the apparatus along the track and the fixed distance between the detector and the specific part of the apparatus.

For generating the record, at least one of the wheels $w_1$, $w_2$, $w_3$, $w_4$ may be equipped with a revolution counter (not shown) that is connected with the control unit and initiates at a defined reference rail position along the track. The control unit may directly map the number of counts of a revolution counter of a wheel to a distance from the reference position, one round corresponding to a length of the circumference of the part of the wheel in contact with the rail. Other means for tracking positions of at least one wheel of the apparatus along the track may be applied within the scope of protection. For example, the apparatus may comprise a specific measuring device, like a laser, Doppler or radio frequency measuring device, which measures its distance to a reference position in one end of the track, and feeds the measured distance to the control unit. Other positioning means applying other reference points, like GPS (Global Positioning System), may also be applied.

The detectors $d_1$, $d_2$, $d_3$, $d_4$ are in operative connection with a control unit 140. Operative connection refers here to a configuration where detectors are connected to the control unit 140, signals generated during operation of the apparatus by the detectors are delivered to the control unit, and the control unit is configured to systematically execute operations on the received signals according to predefined processes, typically programmed processes. These processes may be implemented in hardware or special purpose circuits, software, logic or any combination thereof. Some aspects of the processes may be implemented in hardware, while some other aspects may be implemented in firmware or software, which may be executed by a controller, microprocessor or other computing device. Software routines for execution may be called as program products, and represent articles of manufacture that can be stored in any computer-readable data storage.

Figure 2:
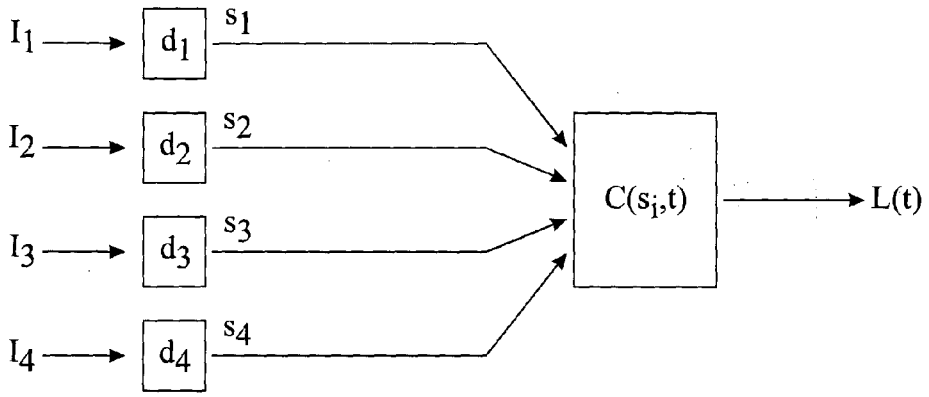
FIG. 2 illustrates operations of the interconnected elements of the system.

FIG. 2 illustrates operations of the interconnected elements of the system. As discussed above, during operation of the system, each of detectors $d_1$, $d_2$, $d_3$, $d_4$ is spatially related to a specific wheel of the apparatus. When the apparatus is moving, the detectors generate signals $s_1$, $s_2$, $s_3$, $s_4$. A signal from a detector represents respectively a lateral distance of a specific part of a related wheel from a rail at the time the signal is generated, i.e. the time the measurement was taken. When the control unit C receives a signal $s_i$, it associates it with identification data that represents this specific position along the track where the lateral distance of the specific part of the wheel from the rail was measured.

In the present example, in order to associate a signal to a specific position along the track, the control unit C associates a received signal $s_i$ with a time indication $t_i$. Detectors may be configured to generate signals continuously or periodically. Typically the route of delivery from a detector to the control unit is very quick, so the interval between the time of generation of the signal and the time of receiving the signal is insignificant and the control unit may associate the signal with a time it receives the signal and validly consider the time indication to correspond to the specific time the lateral distance of the wheel was measured.

However, depending on dimensions of the system and/or distances between the elements, the system configuration may naturally comprise further means for eliminating delays in signal transmission between the detector and the control unit. For example, in some implementations, track monitoring may be implemented remotely based on detector readings from the apparatus received over a communications network. In such implementations, detectors may be more advanced detector systems that comprise a timer and generate signals carrying a measurement result and a recorded or estimated time of the measurement. Correspondingly, the control unit needs to associate signals received from these detector systems with a time indication that is extracted from the signal itself, not with the time of receipt of the signal. This ensures that detector readings correspond with specific temporal lateral distances, and are useful for further processing.

Processes of the control unit comprise comprises a function $C(s_i, T)$ that during operation operates on a group of signals $s_i=(s_1, s_2, s_3, s_4)$ that separately stream from detectors $d_1$, $d_2$, $d_3$, $d_4$. Due to the operative connection between the control unit and the detectors, the control unit is able to identify a source detector for each received signal, and thereby map measurement information provided by a source detector to a respective measured lateral distance $I_1$, $I_2$, $I_3$, or $I_4$ of its related wheel from a rail. In addition, the control unit maps the signal to a specific position along the track.

In this embodiment the control unit extracts and combines at least two signals from detectors that are positioned in the opposite ends $e_1$, $e_2$ of the apparatus and have a matching time indication. Matching time indication T typically means that time indications $t_1$, $t_2$, $t_3$, $t_4$ associated to the signals $s_1$, $s_2$, $s_3$, $s_4$ are within a defined time interval $T_{meas}$ ($t_1, t_2, t_3, t_4 \epsilon T_{meas}$). When the time interval $T_{meas}$ is defined to be short, within milliseconds (for example 30 ms), the signals and thus the lateral distances $I_1$, $I_2$, $I_3$, $I_4$ carried in the signals may be validly considered concurrent. Concurrency of the signals means here that at the time $T_{meas}$, positions of the source detectors in respect to each other and in respect to their related wheels is known, and position of the detectors along the track is available to the control unit. The control unit may thus use concurrent signals in opposite ends of the apparatus and based on them generate an indication L(t) that represents temporal dimensional compatibility of the apparatus and the track in that position.

Figure 3:
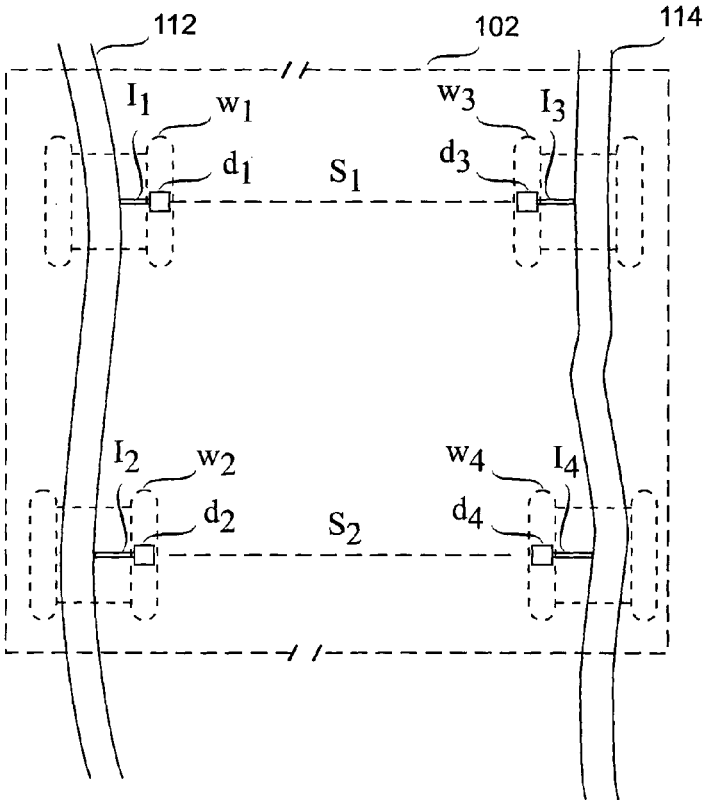
FIG. 3 shows a block chart for illustrating an example of generation of an indication representing temporal dimensional compatibility of the apparatus and the track in configurations of FIGS. 1 and 2.

FIG. 3 shows a block chart for illustrating an example of generation of the indication L(t) with the configuration of embodiment in FIGS. 1 and 2. Same reference numbering has been applied, whenever possible. It is noted the intention of FIG. 3 is meant to illustrate the relevant elements, so dimensions of the configuration are not in scale and are partly exaggerated. FIG. 3 shows the apparatus 102 moving on a track defined by rails 112, 114. Ideally rails are rectilinear, but in practise rails may comprise deformations and defects that, furthermore, may vary in time. The wheels $w_1$, $w_2$, $w_3$, $w_4$ of the apparatus 102 are typically formed with one or more retaining elements that interact physically with the rail to maintain a rotating wheel on the rail. In the embodiment of FIG. 3, the wheels are provided with at least one circular flange, the circular plane of which extends vertically from the outer perimeter of the wheel to prevent lateral movement of the wheel beyond the point of contact with the rail. In operative systems, a considerable amount of flange contacts originate from defects and deformations in the rails. Such contacts are highly undesirable, because they cause a lot of wear and lead to a shortened lifetime for the wheels. Exchange of wheels of an installed crane bridge is a laborious and expensive operation, and causes each time a service break for the crane operations. Any of these disadvantages should be effectively avoided.

In some existing implementations, distances $I_1$ and $I_2$ have been monitored and their mutual relationship has been used to control motor drives of wheels $w_1$, $w_2$, $w_3$, $w_4$ in an attempt to move the crane bridge straight and in the middle of the rails 112, 114. However, as may be seen from FIG. 3, such control operations alone might help to avoid flange contacts of the wheels $w_1$, $w_2$ in the first end $e_1$. However, without any information about the rail dimensions in the other end $e_2$, a control operation may not significantly improve the flange contact situation of wheels $w_3$, $w_4$. As a matter of fact, if severe acute rail deformations occur, a control operation based on measurements in the first end $e_1$ might even worsen the situation, and end up entangling the wheels $w_3$, $w_4$ against the rail 114 or even pushing the wheels $w_3$, $w_4$ in the other end $e_2$ beyond the rail 114.

In order to avoid such situations, in the embodiment of FIG. 3, signals from detectors $d_1$, $d_2$ in one side of the apparatus and detectors $d_3$, $d_4$ in opposite sides of the apparatus 102 are monitored and recorded and used in combination to generate an indication L(t) that represents temporal dimensional compatibility of the apparatus and the whole track defined by both of the rails. Due to the system configuration, the detectors may be operative during normal operations of the apparatus, and create information in loaded and unloaded operational situations. Accordingly, the generated indication L(t) is useful for both the operating system and/or operator, as well as for operational management system (like a Crane Management System (CRM) of a crane bridge) of the apparatus.

For example, in the case of FIG. 3, the control unit may use distances $I_1$, $I_2$, $I_3$, $I_4$ in both ends of the crane bridge to compute one or more indications that represent current dimensions of the track. Here the control unit may compute a value $S_1$ that represents span of the bridge in the front part of the bridge. $S_1$ may be computed on the basis of lateral distances $I_1$, $I_3$ measured with detectors $d_1$, $d_3$ in opposite ends $e_1$, $e_2$ of the bridge. Correspondingly a value $S_2$ that represents span of the bridge in the rear part of the bridge may be computed on the basis of lateral distances $I_2$, $I_4$ measured with detectors $d_2$, $d_4$ in opposite ends $e_1$, $e_2$ of the bridge. The generated span indications $S_1$ and $S_2$ can be directly compared to dimensions of the apparatus, i.e. known distances between wheels $w_1$, $w_3$ and $w_2$, $w_4$.

As another example, the control unit may compile all measured distances $I_1$, $I_2$, $I_3$, $I_4$ to generate a combined indication of flange distances of all wheels at the same time. The combination of distances in the front and rear in both sides of the crane represent the total compatibility of the crane bridge with the underlying rails. Since the rails are initially optimised in relationship with the dimensions of the bridge, the combination of deviations from the dimensions of the bridge directly represent temporal and lateral deviations of the track.

It is noted that the invention is not limited to these exemplary indications. Further lateral dimensions of the rails may be applied as indications without deviating from the scope of protection.

The lateral and temporal information on the dimensions of the track are very important for efficient management system of the apparatus. When compatibility of the apparatus and the rail is monitored continuously, it is possible detect deviations in their early phase and to trigger preventively corrective measures much earlier than before. This way one can prevent development of situations that call for service breaks. For example, in the case of crane bridges, due to the invented solution, the lifetime of the wheels may easily be doubled or tripled, and the interval between the costly wheel changes and related service breaks respectively lengthened.

Continuous monitoring also facilitates collection of history data that may be applied in analysis of problems or of trends leading to problems. Values may be measured with a loaded trolley and unloaded trolley, and with various positions of the trolley, which allows more accurate estimation of the reasons for any noted deviations. For example, the system may be used to compute for a track a set of lateral dimension values (e.g. span values) in defined operational conditions, and prevailing operational conditions may be recorded along with the computed values. Operational conditions may relate to, for example:

- detector/apparatus location along the track
- measurements without load and/or with a defined load
- various driving schemes,
- positions of the trolley,
- wind speed,
- ambient temperature, humidity When the same measurements are taken later in operational conditions that are at least partly the same as before, the earlier values provide history data basis, against which new results may be compared. Detected deviations of new values from earlier values may be interpreted to represent progressive changes in the dimensions of the track and trigger inspections and possible repair and service activities. History data on measured dimension, detected deviations and information on the prevailing conditions generates a broad database, which can be processed to detect trends and/or causalities between varying values and thereby analyse root causes of imminent problems. Due to the embodiment of the invention, potential dimensioning related problems can be avoided or at least detected and repair actions taken well before any damaging effects from incompatibility between the wheels and the rails become apparent.

The distributed configuration also facilitates remote monitoring of the compatibility of the track delivery elements, due to which professional support may be offered as a continuous system service by a crane manufacturer. This ensures accurate and prompt corrective actions since deepest knowledge about behaviour and characteristics of crane systems is typically with professionals designing them. Furthermore, cumulative operation histories from a large number of installed cranes may be collected and applied to thoroughly and proactively analyse problematic compatibility issues within the system.

The lateral and temporal information on the dimensions of the track in comparison with the dimensions of the apparatus may also be fed into the drive logic of the apparatus. The drive logic may apply the generated temporal indication as a further parameter in control of the motor drives of the wheels. For example, the generated indication may reveal a defined position in the track where the rails are deformed such that the span between the wheels is wider that originally designed. In order to minimise effects from flange contacts in such part of the track, the motor drives may be adjusted to move slower when the apparatus moves in that part. Furthermore, the motor drives may be controlled to adjust motor drives according to a logic that optimises the drive of the wheels such that minimum flange contact of all four wheels is achieved. The indication may be also used as a basis for triggering an alarm when the dimensions of the apparatus and the track are considered to deviate excessively. The drive logic is here a logical unit that may be implemented as procedures in the control unit or in a drive unit that part of a separate operating system but is in operative connection with the control unit, or as a combination of procedures of the control unit and one or more separate computer units of the operating system.

As a simple example, let us look into an arrangement for managing motor drives in response to a temporal lateral compatibility of with rails in opposite sides of the apparatus of FIG. 3. In the scenario shown in FIG. 3, the crane is moving upwards in the drawing. As discussed above, the control unit has generated indications $I_1, I_2, I_3, I_4$ for flange distances of all wheels $w_1, w_2, w_3, w_4$ at a defined position along the track. Let us assume that during progressive movement along the track the distances of the wheels to their respective rails are as follows: $I_1$=5 mm, $I_2$=8 mm, $I_3$=28 mm and $I_4$=32 mm. In practise this means that flanges of the wheels $w_1$, $w_2$ are already very close to the rail and some corrective action needs to be taken. The logic that optimises the drive of the wheels analyses the combination of the values $I_1, I_2, I_3, I_4$ and decides to move the apparatus towards rail 114 by 7 mm. This may be implemented by first decelerating rotation of wheels $w_3$, $w_4$ in comparison to rotation of wheels $w_1$, $w_2$ such that the apparatus becomes slightly skewed in relation to the track. By means of this, distances of wheels $w_1$, $w_2$ to rail 112 increase and distances of wheels $w_3$, $w_4$ to rail 114 decrease. When the desired increase/decrease has been achieved, rotation of wheels $w_1$, $w_2$ in comparison to rotation of wheels $w_3$, $w_4$ is decreased such that the apparatus re-aligns in relation to the track. After the corrective movement, the distances of the wheels to are as follows: $I_1$=12 mm, $I_2$=15 mm, $I_3$=21 mm and $I_4$=25 mm, and allow good interoperation of the apparatus and the rails.

As a further example, a more enhanced arrangement for managing motor drives in response to a lateral dimensions in opposite sides of the apparatus of FIG. 3 is described. In the arrangement, the control uses values $I_1$, $I_2$ to compute a first end flange value $Fe_1=(I_1+I_2)/2$ that represents temporal lateral compatibility of wheels in the first end $e_1$ with the underlying rail 112, and values $I_3$, $I_4$ to compute a second end flange value $Fe_2=(I_3+I_4)/2$ that represents temporal lateral compatibility of wheels in the second end $e_1$ with the underlying rail 114.

Figure 4:
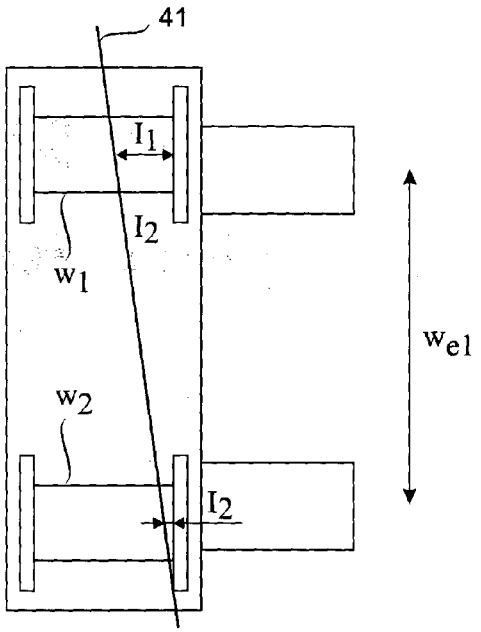
FIG. 4 illustrates definition of a skew value of an end of the apparatus.

In addition, the control unit uses values $I_1$, $I_2$ to compute a first end skew value $Se_1=(I_1-I_2)/w_{e1}$, and values $I_3$, $I_4$ to compute a second end skew value $Se_2=(I_3-I_4)/w_{e2}$. FIG. 4 illustrates definition of a skew value of an end with dimensions of the first end $e_1$. Line 41 represents inner edge of the rail 12 on which the first end $e_1$ runs, and $w_{e1}$ a line connecting corresponding lateral reference points of wheels $w_1$, $w_2$. The length of $w_{e1}$ corresponds with the distance between wheels $w_1$, $w_2$ (generally $w_{e1}=w_{e2}$). It can be seen that the greater the difference between values $I_1$ and $I_2$ is, the more the line $w_{e1}$ deviates from the inner edge of rail 112 and, consequently, the greater is the temporal skew value $Se_1$.

The first and second end flange values $Fe_1$ and $Fe_2$ in the opposite ends $e_1$, $e_2$ are then used to compute an apparatus flange value $AF=(Fe_1+Fe_2)/2$. Correspondingly, temporal first and second end skew values $Se_1$ and $Se_2$ can be used to compute a temporal apparatus skew value $AS=(Se_1+Se_2)/2$.

Figure 5:
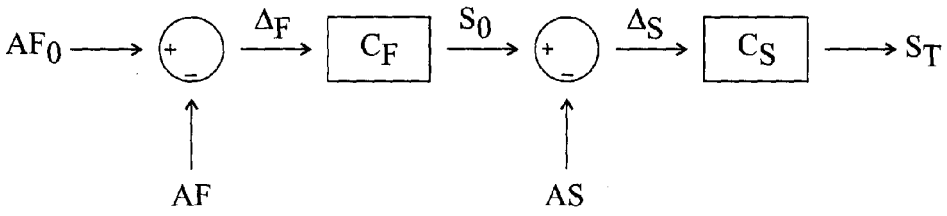
FIG. 5 illustrates a control diagram for generating one or more control signals to an operating system logic that controls motor drives of the wheels.

FIG. 5 illustrates a control diagram that represents a procedure for generating one or more control signals to the operating system logic that controls motor drives of wheels of the apparatus. In the beginning of the computation, the control unit has a predefined value $AF_0$ that represents a desired apparatus flange value. During operation, the control unit computes a temporal apparatus flange value AF and compares it with the desired apparatus flange value $AF_0$. The difference $\Delta_F$ between these two values represents deviation from a desired lateral compatibility between the apparatus and the track. The value $\Delta_F$ may be used as an initial value for a first control procedure $C_F$ that computes a desired rotation necessary to invoke a required skew $S_0$ to compensate the detected difference $\Delta_F$ in a manner described above.

The control unit computes also a temporal apparatus skew value AS and compares it with the computed skew value $S_0$. The difference $\Delta_s$ between these two values represents the amount of additional skew required to achieve the desired lateral position defined by means of $AF_0$. The value $\Delta_s$ may thus be used as an initial value for a second control procedure $C_s$ that generates one or more speed control signals $S_T$ for the motor drives of the wheels $w_1$, $w_2$, $w_3$, $w_4$.

This arrangement facilitates an enhanced drive logic that considers temporal compatibility between the whole apparatus and the track and helps to effectively avoid undesired wear of the parts engaging with the rail during use.

As a further aspect, the embodiments of the invention facilitate an arrangement where recorded history data on compliance between the track and the apparatus is applied to more effectively and economically control motor drives of the apparatus. As discussed with FIG. 5, computation of control signals is typically based on a desired apparatus flange value $AF_0$. In tracks where the span between the rails may vary considerably, using a fixed value as a desired apparatus flange value $AF_0$ may not be appropriate to compensate the considerable deviations in the span. However, history data collected during operation of the apparatus records indications that represent temporal dimensional compatibility of the apparatus and the track in defined positions. This data may thus be applied to vary the value of desired apparatus flange value $AF_0$ such that true dimensions of the track can be premeditatively considered in the drive logic. Accordingly, in the present embodiment, the value applied by the drive logic is not constant, but a function (e.g. a Spline function) of values varying for various positions along the track. By means of this arrangement, for example, a crane bridge coming close to a track position where the span between the rails is narrow may be slightly skewed to compensate the shorter distance between the rails.

In the embodiment of FIG. 5, signals from detectors related to wheels in front and rear part of the apparatus were applied to generate temporal values for the whole apparatus. Since the proposed arrangement is based on applying distances related to wheels in opposite ends of the bridge, it is also possible to generate control signals for drive motors of successive pairs of wheels $w_1$, $w_3$ and $w_2$, $w_4$ separately. In many implementations the dimensions of the apparatus in the direction of the track are much smaller than the lateral dimensions, and shared control values may be applied by all wheels of the apparatus. However, in tracks where deviations may follow each other very closely, such possibility to react to temporal incompatibility issues differently in front and rear parts of the apparatus is very important.

Figure 6:
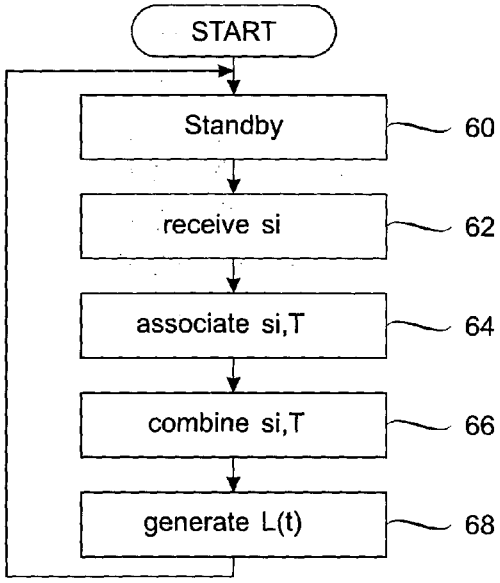
FIG. 6 illustrates steps of a method performed by a control unit of the apparatus of FIG. 1.

Embodiments of the invention comprise also a computer program product that comprises program code means performing steps for a method when the program is run on a computer device. Such a computer device is applicable as a control unit of FIG. 1. The flow chart of FIG. 6 illustrates steps of such a method. The procedure of FIG. 6 begins when the control unit is switched on and in operative connection with an apparatus that comprises a group of detectors, each detector in spatial connection with a wheel of the apparatus. The control unit is thus standby (step 60) to receive and process signals from the detectors. In this embodiment, operative each detector generates to the control unit a signal that represents a lateral distance of a specific part of a specific wheel from a rail. When such a signal is received (step 62), the control unit associates (step 64) the signal with position data, the position data representing a specific position along the track where the lateral distance of the specific part of the wheel from the rail was measured. As discussed in FIG. 2, time of receipt of the signal by the control unit may be applied to determine the position data, or further arrangements may be applied for the purpose. The control unit then combines (step 66) signals that are received from detectors in spatial connection with wheels in opposite sides of the apparatus, and that have a matching time indication. Matching of time indications has been discussed in more detail with FIG. 3. The combined signals are then used to generate (step 68) an indication L(t) that represents temporal dimensional compatibility of the apparatus and the track, as also discussed with FIG. 3.

It will be apparent to a person skilled in the art that various modifications can be made without departing from the scope of the appended claims. For instance, while some of the examples described above refer to a "fixed spatial connection" between the wheels and detectors. While a fixed spatial connection between the wheels and detectors simplifies data processing, those skilled in the art will understand that what is essential is that the spatial connection between the wheels and detectors is known or can be determined. For instance, suppose that the detectors are mounted on flexible mounting bases. On each mounting base, one detector measures the distance to the wheel, while another detector measures the distance to the rail. With this arrangement the distance between a rail and a wheel can be measured although the spatial connection between wheels and detectors is not fixed. The invention and its embodiments are thus not limited to the specific examples described above but may vary within the scope of the claims.

The invention claimed is:

1. A system, comprising:

a crane configured to move along a track defined by rails, the crane comprising two opposite ends, each end carried by two or more wheels on one of the rails, wherein all wheels are parallel to each other;

a control unit in operative connection with the crane;

wherein:

the crane comprises at least one detector for at least two wheels in each of the two opposite ends, wherein the at least one detector for the at least two wheels in each of the two opposite ends is in a known spatial connection with a respective wheel and generates to the control unit a signal that represents a measured lateral distance of a specific part of the wheel from a respective rail;

the control unit receives signals from the at least one detector for at least two wheels in each of the two opposite ends and stores the received signals with associated position data, the position data representing a specific position along the track where the lateral distance of the specific part of the wheel from the rail was measured;

the control unit uses stored received signals from the at least one detector for at least two wheels in each of the two opposite ends of the crane and the associated position data to generate an indication representing temporal dimensional compatibility of the crane and the track, the temporal dimensional compatibility indicating compatibility of the crane and the track in a position that the crane is moving into, the crane uses the indication representing temporal dimensional compatibility of the crane and the track to generate a rotational speed difference between the wheels of the two opposite ends to re-align the crane with the track.

2. The system according to claim 1, further comprising a recorder that generates a record storing positions of a specific part of the crane along the track as a function of time, and the control unit being configured to use the record to map one or more of the stored positions to a respective position of the at least one detector along the track.

3. The system according to claim 2; wherein the control unit:

identifies at least one of the at least one detector in each of the two opposite ends as a source detector of a received signal;

identifies a time of measurement by the source detector;

uses the record to map the time of measurement to one of the stored positions; and maps the one of the stored positions to a respective position of the at least one detector along the track; and uses the position of the at least one detector along the track as position data of the signal.

4. The system according to claim 1, wherein the indication representing temporal dimensional compatibility of the crane and the track is a value representing a lateral dimension of the track.

5. The system according to claim 4, wherein the control unit uses signals received from two detectors in said spatial connection with wheels in opposite ends of the crane to generate values for span between the rails defining the track.

6. The system according to claim 1, wherein the system is connected to an operational management system, and the control unit transmits the indication representing temporal dimensional compatibility of the crane and the track to the operational management system.

7. The system according to claim 1, wherein the crane runs a route on the track, and the control unit generates a group of indications representing temporal dimensional compatibility of the crane in positions along the route on the track.

8. The system according to claim 7, wherein the control unit further delivers, with the group of indications, values representing prevailing operational conditions during the run.

9. The system according to claim 1, further comprising a drive logic guiding driving arrangements of the wheels, and the control unit feeds the indication representing temporal dimensional compatibility of the crane and the track to the drive logic.

10. The system according to claim 9, wherein the drive logic computes for an end of the crane an end flange value that represents temporal lateral compatibility of wheels in with an underlying rail in the end of the crane, and an end skew value that represents a level of skew of a line connecting successive wheels in the end of the crane.

11. The system according to claim 10, wherein the drive logic comprises:

a first control procedure applying the computed end flange value to determine a desired rotation of the wheels for the end for which the end flange value was computed; and a second control procedure applying the computed end skew value to determine one or more speed control signals for one or more motor drives.

12. The system according to claim 9, wherein the drive logic applies a variable end flange value that is computed from a function for various positions along the track.

13. The system according to claim 1, wherein the at least one detector for at least two wheels in each of the two opposite ends is vertically aligned with an axis of the respective wheel.

14. The system according to claim 1, wherein the control unit stores, with the received signals and associated position data, information on prevailing conditions, wherein the information on prevailing conditions comprises one or more of: load of the crane, position of a load-bearing part of the crane, a selected driving scheme, wind speed, ambient temperature and humidity.

15. A method, comprising:

moving a crane on wheels along a track defined by rails, the crane comprising two opposite ends, each end carried by two or more wheels on one of the rails, wherein all wheels are parallel to each other, and a control unit in operative connection with the crane;

wherein the crane comprises at least one detector for at least two wheels in each of the two opposite ends, wherein the at least one detector for the at least two wheels in each of the two opposite ends is in a known spatial connection with a respective wheel and generates to the control unit a signal that represents a measured lateral distance of a specific part of the wheel from a respective rail;

the control unit receives signals from the at least one detector for at least two wheels in each of the two opposite ends and stores the received signals with associated position data, the position data representing a specific position along the track where the lateral distance of the specific part of the wheel from the respective rail was measured;

the control unit uses the stored received signals from the at least one detector for at least two wheels in each of the two opposite ends of the crane and the associated position data to generate an indication representing temporal dimensional compatibility of the crane and the track, the temporal dimensional compatibility indicating compatibility of the crane and the track in a position that the crane is moving into;

the crane uses the indication representing temporal dimensional compatibility of the crane and the track to generate a rotational speed difference between the wheels of the two opposite ends to re-align the crane with the track.

16. A non-transitory computer-readable medium comprising computer-readable code configured to control the system as defined in claim 1, wherein execution of the computer-readable code in a control unit coupled to the controlled system causes execution of the following acts:

moving a crane on wheels along a track defined by rails, the crane comprising two opposite ends, each end carried by two or more wheels on one of the rails, wherein all wheels are parallel to each other, and a control unit in operative connection with the crane, wherein the crane comprises at least one detector for at least two wheels in each of the two opposite ends, wherein the at least one detector for the at least two wheels in each of the two opposite ends is in a known spatial connection with a respective wheel and generates to the control unit a signal that represents a measured lateral distance of a specific part of the wheel from a respective rail;

the control unit receives signals from the at least one detector for the at least two wheels in each of the two opposite ends and stores the received signals with associated position data, the position data representing a specific position along the track where the lateral distance of the specific part of the wheel from the respective rail was measured;

the control unit uses the stored received signals from the at least one detector for at least two wheels in each of the two opposite ends of the crane and the associated position data to generate an indication representing temporal dimensional compatibility of the crane and the track, the temporal dimensional compatibility indicating compatibility of the crane and the track in a position that the crane is moving into;

the crane uses the indication representing temporal dimensional compatibility of the crane and the track to generate a rotational speed difference between the wheels of the two opposite ends to re-align the crane with the track.

* * * * *